US011084315B2

(12) United States Patent
Lesur et al.

(10) Patent No.: US 11,084,315 B2
(45) Date of Patent: Aug. 10, 2021

(54) COLOR LASER MARKING OF SECURITY DOCUMENT AND A METHOD FOR PRODUCING SUCH SECURITY DOCUMENT

(71) Applicant: THALES DIS FRANCE SA, Meudon (FR)

(72) Inventors: Jean-Luc Lesur, Meudon (FR); Nina Larina, Meudon (FR); Jarmo Nikkila, Meudon (FR)

(73) Assignee: THALES DIS FRANCE SA, Meudon (FR)

( * ) Notice: Subject to any disclaimer, the term of this patent is extended or adjusted under 35 U.S.C. 154(b) by 0 days.

(21) Appl. No.: 16/958,267

(22) PCT Filed: Dec. 17, 2018

(86) PCT No.: PCT/EP2018/085258
§ 371 (c)(1),
(2) Date: Jun. 26, 2020

(87) PCT Pub. No.: WO2019/129527
PCT Pub. Date: Jul. 4, 2019

(65) Prior Publication Data

US 2020/0331284 A1 Oct. 22, 2020

(30) Foreign Application Priority Data

Dec. 27, 2017 (EP) ..... 17306939

(51) Int. Cl.
*B42D 25/41* (2014.01)
*B42D 25/351* (2014.01)
(Continued)

(52) U.S. Cl.
CPC ..... *B42D 25/41* (2014.10); *B42D 25/351* (2014.10); *B42D 25/382* (2014.10); *B42D 25/45* (2014.10);
(Continued)

(58) Field of Classification Search
CPC .... B42D 25/41; B42D 25/351; B42D 25/382; B42D 25/45; B42D 25/23; B42D 25/21; B42D 25/29; B42D 25/24
(Continued)

(56) References Cited

U.S. PATENT DOCUMENTS 7,198,302 B1 * 4/2007 Fannasch ..... B42D 25/00 283/100

FOREIGN PATENT DOCUMENTS

EP 2719540 A1 4/2014
EP 2719541 A1 4/2014
(Continued)

OTHER PUBLICATIONS

PCT/EP2018/085258, International Search Report, dated Mar. 14, 2019, European Patent Office, P.B. 5818 Patentlaan 2 NL-2280 HV Rijswijk.
(Continued)

*Primary Examiner* — Justin V Lewis
(74) *Attorney, Agent, or Firm* — The Jansson Firm; Pehr B. Jansson

(57) ABSTRACT

The present invention relates generally to a data carrier and a method for making the data carrier. More particularly, this invention relates to color laser marking of article, especially security documents. The present invention proposes a security document comprising a multilayers assembly instead of a single color component mixture in a layer. The multilayer assembly comprises at least two laser sensitive layer. Each layer comprises at least one coloring agent component. The order arrangement of the multilayers of bleachable coloring agent component is made so that each layer behaves as a wavelength filter configured to selectively transmit longer
(Continued)

wavelengths and block or attenuate shorter wavelengths while protecting the underneath coloring agent component from bleaching interference.

22 Claims, 4 Drawing Sheets

(51) Int. Cl.

| | |
|---|---|
| ***B42D 25/382*** | (2014.01) |
| ***B42D 25/45*** | (2014.01) |
| ***B42D 25/21*** | (2014.01) |
| ***B42D 25/23*** | (2014.01) |
| ***B42D 25/24*** | (2014.01) |
| ***B42D 25/29*** | (2014.01) |
| ***B42D 25/387*** | (2014.01) |
| ***B42D 25/378*** | (2014.01) |

(52) U.S. Cl.
CPC ..... *B42D 25/21* (2014.10); *B42D 25/23* (2014.10); *B42D 25/24* (2014.10); *B42D 25/29* (2014.10)

(58) Field of Classification Search
USPC ..... 283/67, 72, 81, 85, 91, 94, 98, 109, 901
See application file for complete search history.

(56) References Cited

FOREIGN PATENT DOCUMENTS

| | | |
|---|---|---|
| WO | WO9635585 A1 | 11/1996 |
| WO | WO0115910 A2 | 3/2001 |

OTHER PUBLICATIONS

PCT/EP2018/085258, Written Opinion of the International Searching Authority, dated Mar. 14, 2019, European Patent Office, D-80298 Munich.

* cited by examiner

COLOR LASER MARKING OF SECURITY DOCUMENT AND A METHOD FOR PRODUCING SUCH SECURITY DOCUMENT

TECHNICAL FIELD

This invention relates generally to a data carrier and a method for making the data carrier. More particularly, this invention relates to color laser marking of articles, especially security documents.

BACKGROUND ART

Security documents are associated with secure applications, such as for example driving licenses, identity cards, membership cards, badges or passes, passports, discount cards, banking cards, money cards, multi-application cards, and other papers of value; and security documents such as bank notes. Such security documents are widely used, they may comprise an electronic module or not. If they comprise an electronic module, they can function either with contact and/or without contacts depending on the application to which they are intended for. They may take the shape of a card or a booklet or something else.

Because of the value and importance associated with each of these security documents, they are often the subject of unauthorized copying and alterations, and forgeries.

Document falsification and product counterfeiting are significant problems that have been addressed in a variety of ways. Different types of visual and tactile security features have been added to security documents.

Laser marking of security documents with producing bright color markings is a known method of ensuring product safety and authenticity. A security document in the form of a solid body or a coating comprises a layer with a mixture of colorants, most often pigments, and is irradiated by lasers using different wavelengths to produce the laser markings. Under laser irradiation, the embedded pigments undergo color changes, resulting in the visual appearance of marks of targeted colors. When selecting primary-colored pigments to compose the initial color component mixture, a variety of chromatic colors can be produced upon laser treatment, resulting in photographic image quality.

WO 96/35585 discloses a method for applying colored information in which at least three different pigments, each having a chromatic color, are used as color-forming components, and are selected in such a way that the mixture absorbs at least a portion of the amount of incident light at every wavelength in the entire visible spectral range from 400 nm to 700 nm.

FIG. 1 is an illustration of the application of the method disclosed in WO 96/35585 to the security document 10. The security document 10 comprises several layers wherein one is a support body 15 of a layer 16 comprising a mixture 11 of various colorants.

Under irradiation with intensive laser light of a specific wavelength, preferably in each case the wavelength is close to each colorant's absorption maximum, these colorants lose their absorption property, at least partially. In this way, they may be bleached, at least partially. Thus, wavelength-selective bleaching by laser radiation allows producing local colored spots.

Ideally, the layer 16 to which the colored information is to be applied comprises a mixture of the following colorants:

a first colorant 17, which primarily absorbs blue light 14 (about 430-470 nm)—the inherent color of this colorant is yellow, a second colorant 18, which primarily absorbs green light 13 (about 530 nm)—the inherent color of this colorant is red (magenta), a third colorant 19, which primarily absorbs red light 12 (about 630-670 nm)—the inherent color of this colorant is blue (cyan).

These colorants 11 are present in the layer 16 distributed equally in such concentrations that the layer appears black. By means of wavelength-selective bleaching of the individual colorants it is possible to generate targeted specific color marks in the layer 16 using the scheme of subtractive color mixing.

However, one drawback of this color laser marking technology lies in undesired color changes resulting from imperfect selectivity of addressing one specific colorant species per laser wavelength. Indeed, absorption bands of the mentioned three colorants 17, 18 and 19 in the visible spectral range are usually wide and not perfectly separated from one another, as schematically represented in FIG. 2, but are strongly overlapping as illustrated in FIG. 3. FIG. 2 illustrates idealistic shapes of absorption spectral bands, conventionally represented as Gaussian curves for the three colorants 17, 18 and 19. FIG. 3 illustrates an experimental result of a superposition of normalized absorption bands of an example of three real colorants 17, 18 and 19.

Likewise, in the range in which the yellow colorant 17 absorbs, the magenta colorant 18 and the cyan colorant 19 may also absorb, as illustrated in the experimental result of FIG. 3.

At the same time, the empirical effective reactivity of a colorant does not fully correlate with its absorption coefficient observed at the defined wavelength. A colorant with lower absorbance at a certain wavelength can be found more "sensitive" to the irradiation at this wavelength than another colorant with higher absorbance.

For example, in a layer comprising a mixed set of colorants, it has been observed that the blue laser is able to bleach the yellow and the magenta colorants at the same energy level. The same blue laser is also able to bleach the cyan colorant at a higher energy level which is also necessary to fully bleach the yellow. The resulting color of the layer therefore depends in each case not only on a relative absorption coefficients—but also on relative effective laser reactivity of each colorant in the mixture versus the laser light of the given wavelength.

The meaning of an "effective laser reactivity" for a given colorant under the light of a given wavelength is the minimum energy input required to achieve a targeted color change. This value is found empirically for each particular configuration and depends on the entire lot of photo-induced processes in the substrate material. For the same wavelength, the "effective laser reactivity" may not necessarily corroborate with the measured absorption coefficient.

The non-selective reactivity of the three colorants with regard to the effective range of light intensities of the three lasers results in a narrowing of the achievable color gamut of the produced color marking, as schematically shown in FIG. 4. In the described example, it is impossible to reach for example a pure magenta or cyan. The described "side-effect" discoloration of the magenta and the cyan primary colors is detrimental to the quality, in particular colorfulness, of the final image.

Therefore, it would be highly beneficial to improve the color laser marking system for producing security documents wherein the drawback of the non-selective bleaching of the three colorants with regard to the effective light intensities of the bleaching lasers is overcome or reduced while improving the image colorfulness (such as achieving pure magenta and cyan colors) without significant increase in the complexity of the laser marking apparatus.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The present invention addresses the aforementioned drawbacks of the prior art by enlarging the color gamut for the color laser markings.

The object of the invention is to provide a multilayer body which, upon specific laser treatment, guarantees a particularly high level of safeguard against forgery and in particular permits laser-induced markings to be produced. Another object of the invention is to provide a process for producing novel laser-induced markings.

The present invention proposes a security document comprising a multilayer body which comprises a multilayer assembly of layers instead of a single mixture of the pigments in one layer as previously proposed. The multilayer assembly comprises at least two separate layers which could be adjacent or separated by a transparent layer.

According to an embodiment of the present invention, each layer is a laser-sensitive layer. The layer can comprise at least one color component. The color component can be any color change component which is responsive to a particular wavelength. When exposed to such wavelength, the color component undergoes full bleaching or passes from one chromatic color to a different chromatic color. The color change component is one colorant from, for example, pigments or eventually dyes or "latent pigments".

In the embodiments hereinafter described, the color component is a bleachable color component. The bleachable color component can be bleached under given wavelength. The bleachable color component is one colorant from, for example, pigments or eventually dyes or "latent pigments". In an embodiment, the bleachable color component is one color component corresponding, for example, to the three primary colors of the subtractive color scheme that can be yellow, magenta and cyan. The bleachable color component can be also any other color such as orange, red, purple, green, blue, . . . In an embodiment, the bleachable color component is one color component from, for example, the three primary colors consisting of red, green and blue.

With this multilayer assembly comprising layers of color components, it becomes possible to produce a multicolor image or full-color image with a wider color space compared to the color space generated from one single layer comprising a mixture of a set of colorants as disclosed in the prior art.

A set of rules is defined to configure each color component layer of the multilayer assembly in order to expand the attainable color gamut. The order arrangement of the colored component layers in the multilayer assembly is designed in a way that each layer acts as an absorptive optical filter configured to selectively transmit the laser irradiation of certain (for example longer) wavelengths and block or attenuate the light of other (for example shorter) wavelengths. The order arrangement of the color component layer in the multilayer assembly is also designed in a way that prevent selected color component from any color change in the aim to widen the color gamut.

The configuration of the order arrangement of the layers of the multilayer assembly is defined according to an absorption coefficients and an effective laser reactivity of each color component. Indeed, the effective laser reactivity could not be in exact correspondence with the absorption spectra, for instance as illustrated in FIG. 3, the color component magenta reacts to the blue laser at a same light intensities than the color component yellow.

In an embodiment, the configuration arrangement of the color component layer of the multilayer assembly can be determined according to these two rules:

in a first configuration, it is defined a first layout of the layers wherein each layer act as a longpass filter for the layers located below. This determination is function of the absorption coefficients of the color components of these layers at the defined laser wavelengths.

in a second configuration, it is determined a second optimized layout wherein the first layout of the order arrangement of the layers can be changed (for example inversing two layers) according to the observed effective laser reactivities of the color components of these layers.

The second, optimized, configuration can be considered as an empirical correction of the first configuration in case the comparative effective laser reactivity of the given set of color component toward the existing set of lasers exhibit a "wrong" order.

These two configuration rules can be executed in reverse order according to the implementation.

According to the implementation, the layers of the multi assembly can be separated from each other by a layer transparent to the laser beam. In an embodiment, the transparent layer can comprise color component which is not bleachable or not color change by the wavelength and/or fillers which can be transparent such glass, silicia or metal. . . .

In an example of configuration, the top most layer of the multilayer assembly can operate as an optical bandpass filter wherein a first particular wavelength band was effectively blocked or attenuated by the color component. A second layer arranged underneath the top layer of the multilayer assembly can operate as an optical bandpass filter wherein a second wavelength band different from the first wavelength band was effectively blocked or attenuated by the color component of the second layer. And so on. . . .

With these successive optical bandpass filters transmitting the light of different wavelength ranges, the achievable color gamut is expanded without loss of luminance.

The present invention with the multilayer assembly composed of different color components films allows to expand the color gamut in which the color images are generated and to improve the perceived quality of the generated image.

In an embodiment of the present invention, each layer of the multilayer assembly comprises at least one color component from the three primary colors consisting of yellow, magenta or cyan. Each of the layers may act as a filter for a particular wavelength range. Each of the layers can be integrated into the multilayer assembly according to their particular wavelength filtering capacity (absorption coefficient) and their relative effective laser reactivity. With respective specific control of the laser treatment for each of the various layers of the multilayer assembly, it is possible to produce by a laser-induced process specific different image components which can jointly compose any complex multilayer image.

In an embodiment, in a layout of the multilayer assembly, a first order configuration of the layers is defined according to the absorption coefficient of the color components. According to this first configuration, the multilayer assembly can comprise on its upper side a first layer with a coloring agent yellow. This first layer with the coloring agent yellow allows to block or attenuate the wavelength band under about 470-500 nm (blue light) while other wavelengths (Infrared, red light, green light) pass through. The first layer acting as a filter prevents the blue laser light from bleaching the color component magenta and the cyan located underneath, thus allowing to obtain a full pure magenta or cyan color gradient.

According to this first configuration, the multilayer assembly comprises a second layer with a coloring agent magenta. The second layer is arranged on the rear side of the first layer. This second layer allows to block or attenuate the wavelength band centered about 530 (green light) while light beams of longer wavelengths (>600 nm-red, Infrared) pass through.

According to this first configuration, the multilayer assembly comprises a third layer with a coloring agent cyan. The third layer is arranged on the rear side of the second layer. This third layer allows to block or attenuate the wavelength band centered at about 671 nm (red light) while longer wavelengths (Infrared) pass through.

In this first configuration, an experimental result shows that the color component magenta has a very high effective laser reactivity compared to the yellow and the cyan pigments. Indeed, the color component magenta is sensitive at very low level energy light to all the three applied lasers: red, blue and green. With the first configuration, the color component magenta can be bleached by the red laser wavelength. Moreover, the color component magenta can be hypersensitive to the blue light, and the yellow upper layer of the multilayer assembly is insufficient to fully avoid the bleaching of the magenta layer underneath. The first configuration can result to an improved color gamut where the pure cyan color can be achievable but a pure magenta could be still missing.

To overcome this detrimental discoloration of the color component magenta, a second order of arrangement of the layers is defined according to the effective laser reactivity of the color component of each layer.

From the first configuration, the color component magenta has to be protected from the red laser light and the blue laser light. The color component cyan is very weakly absorbing the green laser light and is not bleached by it. The second layer of the first configuration is then swapped with the third layer. The new second layer is then the layer comprising the color component cyan. This second layer allows to block or attenuate the wavelength band centered at about 670 nm (red light) while other color wavelengths (Infrared, green) can pass through. The second layer acting as a filter prevents the red laser wavelength from bleaching the magenta pigments allowing to reach a full pure magenta gradient. Placing the cyan layer in the intermediate position adds also an extra filtration of the blue light and the energy threshold for bleaching the color component cyan by the blue laser is higher.

With this example of layout of the layers in the multilayer assembly, the drawbacks of the bleaching characteristics by the different lasers are significantly reduced. The successive order of the arranged layers is defined to create a filter for each laser whenever needed, while improving the range of possible output colors.

With the present invention, instead of mixing different color components in a single layer—it is proposed to select a specific order of different layers, each one containing a selection of colorants or only one colorant, (chromatic or bleachable). The target is to filter off the laser light in the upper layers with the purpose of avoiding side effect on the lower layers. With this configuration, it is possible to obtain the missing colors, for example magenta and cyan, compared to the prior art.

However, using a specific arrangement of the layers comprising at least one bleachable component—yellow, magenta and cyan—isn't sufficient for a good visual quality perception. Indeed, incomplete bleaching of the topmost layer always causes (by reflection of the incident light from the bulk of the said layer) a corresponding visible color shade of the picture, e.g. yellowish aspect in the described embodiment.

To overcome this drawback, the present invention proposes to add an upper layer having all the bleachable color components in a neutral equilibrated mixture, even at low concentration. Such upper layer allows to considerably reduce the appearance of the colored tint without destroying the benefits of the multilayered color component bleaching process.

The present invention allows an optimization of the laser-induced process when passing from a single layer comprising a mixture of the set of the color components to a multilayer assembly where each layer comprises a specific selection of color component in appropriate concentrations, in order to provide better results.

The present invention allows to improve the color space and the visual perception of the color quality, provides better full range colors including pure primary colors, for example magenta, yellow and cyan colors, colors that a standard security document could request.

To achieve those and other advantages, and in accordance with the purpose of the invention as embodied and broadly described, the invention proposes a multilayer assembly, said multilayer assembly comprising at least two layers, each layer comprises at least one laser-reactive color-forming component, a color marking is produced in the bulk of the multilayer assembly of the security document by irradiating the color-forming components of the layers by means of selective wavelength-, wherein the layers are arranged so that:

each layer acts as an absorptive optical filter configured to selectively transmit laser irradiation of certain wavelengths and block or attenuate the light of other wavelengths, and that during the irradiation process of a selected color-forming component, an interference or a side-effect from the underneath color-forming components is avoided or at least minimized.

The present invention is related to a multilayer assembly comprising at least two layers, each layer comprises at least one color-forming component, a color marking is produced within the multilayer assembly of the security document by selective transformation of the color-forming components of the layers by irradiation at selected laser wavelengths, wherein the layers are arranged so that:

each layer acts as an absorptive optical filter configured to selectively transmit the light of certain wavelengths and block or attenuate the light of other wavelengths, and that during the irradiation of a selected color-forming component by a selected laser wavelength, an untargeted radiation exposure of the color forming component underneath the selected color-forming component is avoided or at least minimized.

In an embodiment, the layout of the layers is determined according to two parameters:

an absorption coefficient of each color-forming component of the layers at a given wavelength, an effective laser reactivity of each color-forming component of the layers, said effective laser reactivity corresponding to the minimum energy input of the given wavelength required to achieve a targeted color change of the color-forming component.

In an embodiment, the layers are arranged so that:

according to the coefficient of absorption of each color-forming component, each layer acts as a longpass filter wherein laser irradiation of longer wavelength are transmitted whereas laser irradiation of shorter wavelength are blocked or attenuated, and according to the effective laser reactivity of each color-forming component, each layer allows to minimize the untargeted radiation exposure of the underneath color-forming components.

In an embodiment, the color component is a chromatic color which passes from one chromatic color to a different chromatic color when exposed to a given wavelength, or a bleachable color component which is bleached under given wavelength.

In an embodiment, the layers are separated by a layer transparent to laser irradiation.

In an embodiment, a sensitive layer is added over the upper layer of the multilayer assembly, said sensitive layer comprising a color component mixture of at least two color-forming components.

In an embodiment, the concentration of the color component mixture is lower compared to the concentration of the color-forming components in the layers of the multilayer assembly.

In an embodiment, the color-forming component is color component or dye or "latent pigment".

In an embodiment, the laser layers comprise:

on its upper surface a first layer with a bleachable color-forming component yellow which is able to block or attenuate wavelength band in the blue light, while other color wavelengths pass through, a second layer arranged on the rear side of the first layer with a bleachable color-forming component cyan, said second layer being able to block or attenuate wavelength band in the red light while other wavelengths pass through, a third layer arranged on the rear side of the second layer with a bleachable color-forming component magenta, said third layer being able to block or attenuate wavelength band under in the green light while other color wavelengths pass through.

In an embodiment, the multilayer assembly is covered by a lamination layer transparent to the laser wavelengths.

The present invention also relates to a multilayered security document comprising a body support over which is arranged a multilayer assembly, said multilayer assembly comprising at least two layers, each layer comprises at least one color-forming component, a color marking is produced on the multilayer assembly of the security document by selective transformation of the color-forming components of the layers by irradiation at selected laser wavelengths, wherein the layers of said multilayer assembly are arranged according to the multilayer assembly of the present invention.

In an embodiment, the body support comprises an opaque white core support, a white opacifying layer coated onto a transparent polymeric support, a colored core support or a transparent core support.

In an embodiment, the security document comprises an infrared laser markable layer for generating different optical densities of grey to black, said infrared laser markable layer being arranged between the multilayer assembly and the body support.

In an embodiment, the security document comprises one or more other security features arranged on a layer between the body support and the multilayer assembly or over the multilayer assembly.

In an embodiment, the multilayers of the security document are laminated on the body support of the security document.

In an embodiment, the security document is a physical media such as smart cards (both contact and contactless smart cards), driver's licenses, passports, government-issued identity cards, bankcards, employee identification cards, security documents, personal value papers such as registrations, proofs of ownership, visas, immigration documentation, security badges, certificates, voter registration cards, police ID cards or border crossing cards.

The present invention also relates to a method of color laser marking of a multilayered security document comprising a multilayer assembly, said multilayer assembly comprising at least two layers, each layer comprises at least one color-forming component, a color marking is produced on the multilayer assembly of the security document by selective transformation of the color-forming components of the layers by irradiation at selected laser wavelengths, wherein the layers of said multilayer assembly are arranged according to the multilayer assembly of the present invention.

Other aspects and advantages of the invention will become apparent from the following detailed description, taken in conjunction with the accompanying drawings, illustrating by way of example the principles of the invention.

BRIEF DESCRIPTION OF THE DRAWINGS

The following detailed description will be better understood with the drawings, in which.

DETAILED DESCRIPTION OF THE EMBODIMENTS OF THE INVENTION

Figure 1:
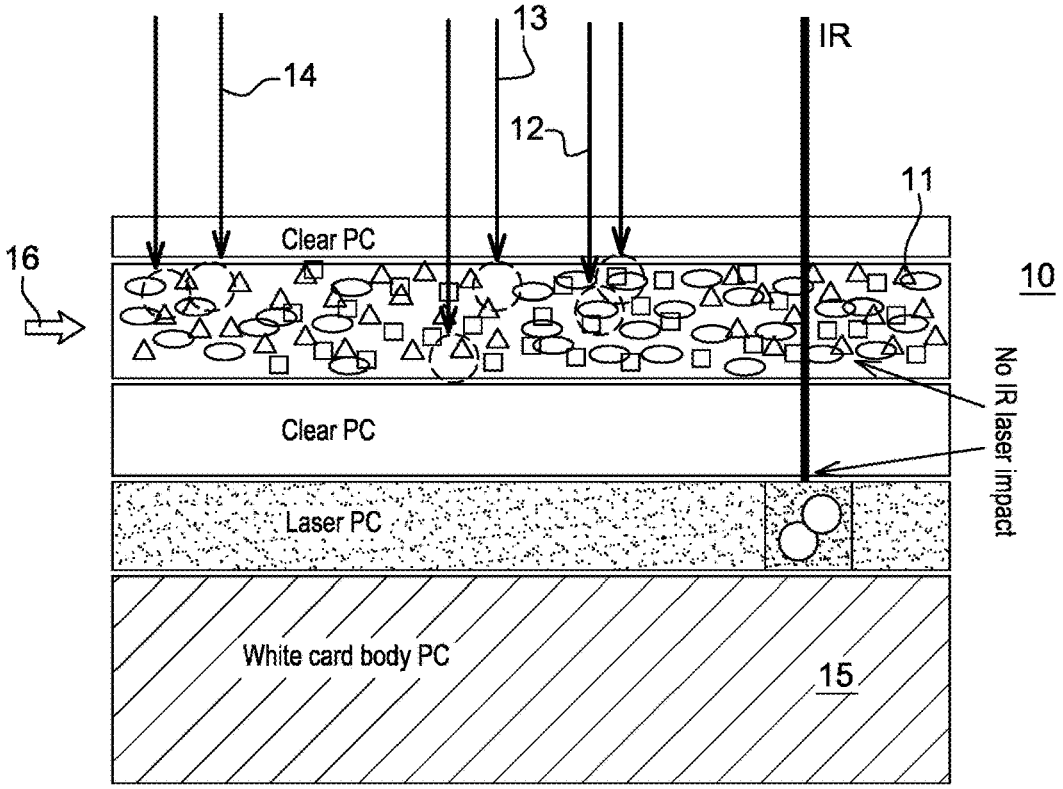
FIG. 1 schematically illustrates a sectional view of a multilayered security document, in the prior art, comprising a layer with a mixture of a set of colorants.
Figure 2:
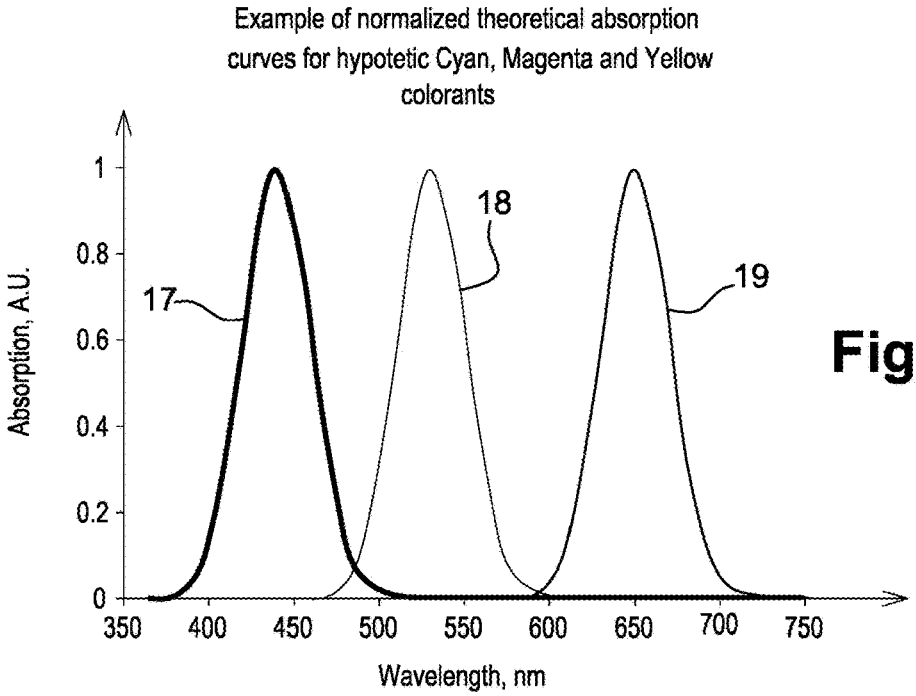
FIG. 2 illustrates idealistic shapes of absorption spectral bands, conventionally represented as Gaussian curves, for three hypothetic colorants: cyan, magenta and yellow.
Figure 3:
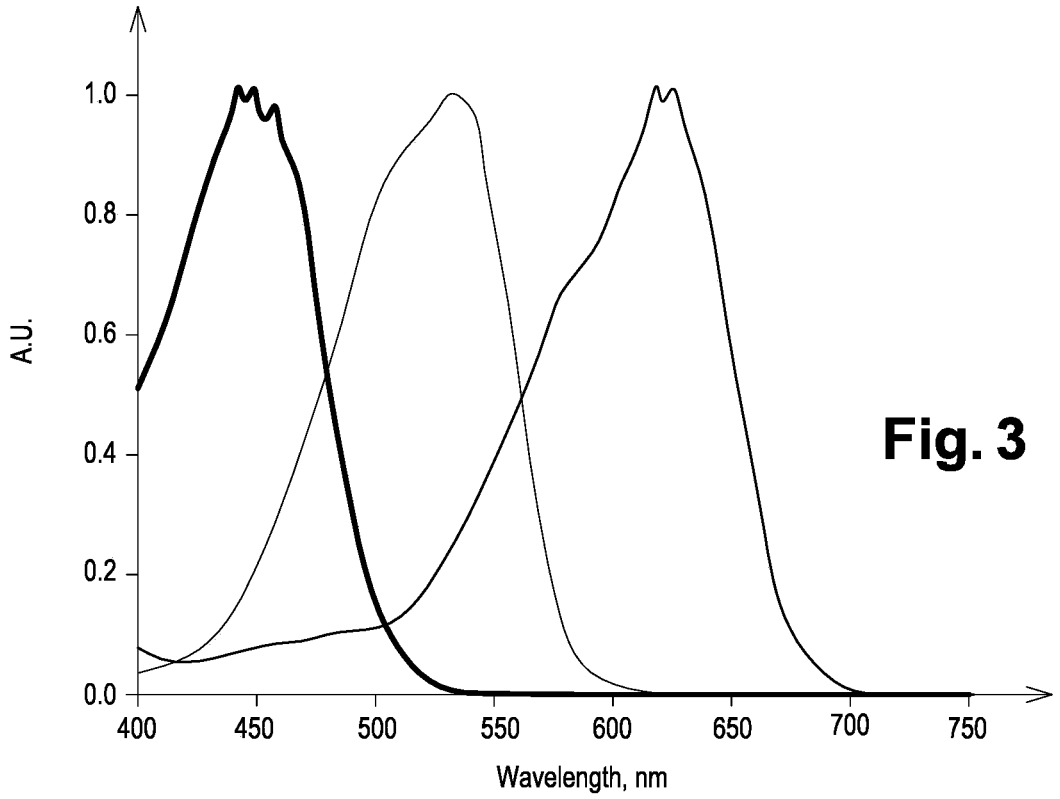
FIG. 3 illustrates normalized absorption bands of an example of three real pigments: cyan, magenta and yellow.
Figure 4:
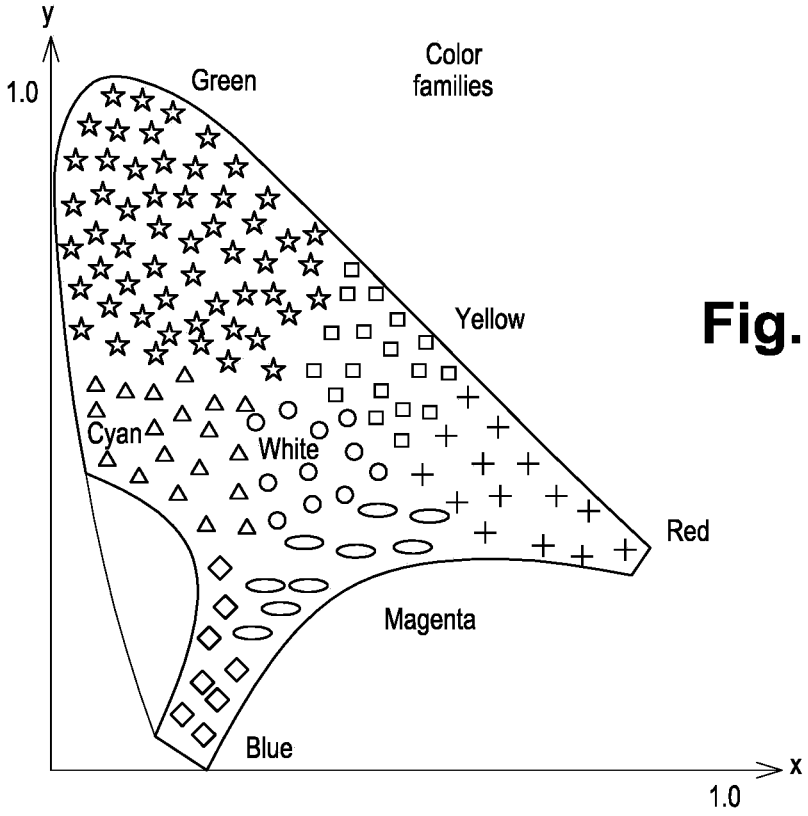
FIG. 4 schematically illustrates a diagram of the color gamut available after the bleaching laser treatment of the layer of the mixed pigments in the prior art.

In order to overcome the problems described above, preferred embodiments of the present invention provide a simple and cost-effective method of color laser marking articles as described herein.

It is a further object of the present invention to provide security documents having an improved image quality and which are more difficult to falsify.

Further advantages and embodiments of the present invention will become apparent from the following description.

It is to be understood that various other embodiments and variations of the invention may be produced without departing from the scope of the invention. The following is provided to assist in understanding the practical implementation of particular embodiments of the invention.

The same elements have been designated with the same referenced numerals in the different drawings. For clarity, only those elements which are useful to the understanding of the present invention have been shown in the drawings and will be described.

Reference throughout the specification to "an embodiment" or "another embodiment" means that a particular feature, structure, or characteristic described in connection with an embodiment is included in at least one embodiment of the subject matter disclosed. Thus, the appearance of the phrases "in an embodiment" or "in another embodiment" in various places throughout the specification is not necessarily referring to the same embodiment. Further, the particular features, structures or characteristics may be combined in any suitable manner in one or more embodiments.

Figure 5:
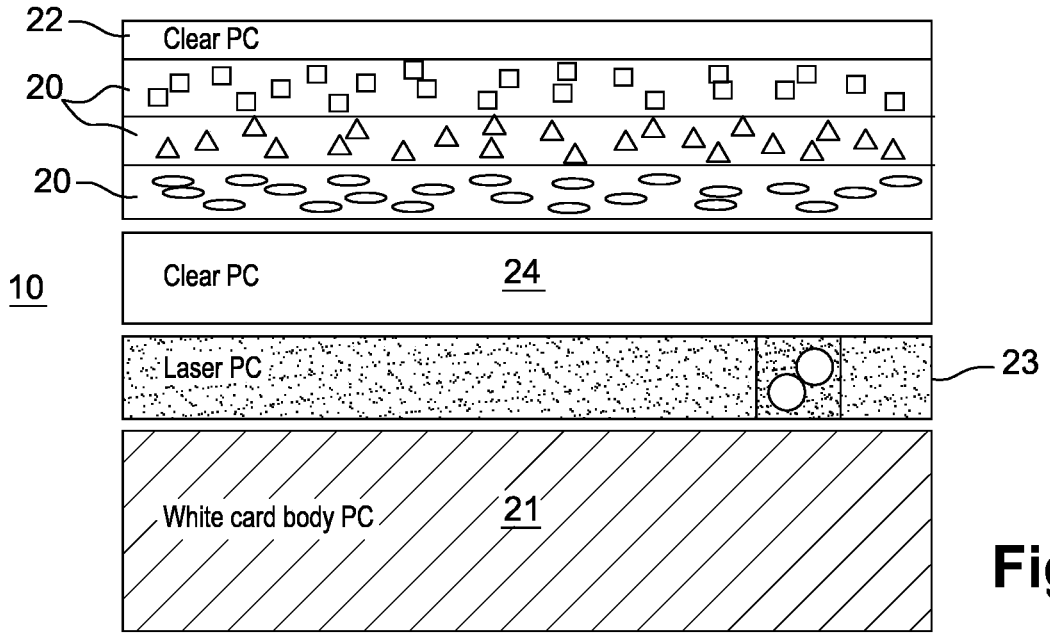
FIG. 5 schematically illustrates a sectional view of a multilayered security document, according to an implementation of the present invention, comprising a multilayer assembly.

FIG. 5 shows an illustrative cross-sectional view of a multilayered personalized security document 10 in accordance with one embodiment of the present invention.

An embodiment of the present invention provides a mechanism by which physical media such as identification cards, bank cards, smart cards, passports, value papers, etc. may be personalized in a post-manufacturing environment. This technology may be used to place images onto such articles inside a lamination layer after the lamination layer has been applied.

Herein, with the purpose of providing a clear narrative, the term security document is used to refer to the entire class of physical media to which the herein-described techniques may be applied even if some such physical media are not "cards" in a strict sense. Without limiting the application of the term security document, it is intended to include all such alternatives including but not limited to smart cards (both contact and contactless smart cards), driver's licenses, passports, government issued identity cards, bankcards, employee identification cards, security documents, personal value papers such as registrations, proofs of ownership, visas, immigration documentation, security badges, certificates, voter registration cards, police ID cards, border crossing cards, etc.

The security document carries certain items of personalized information which relate to the identity of the bearer. Examples of such personalized information include name, address, birth date, signature and photographic image; the security document may in addition carry other variable data (i.e., data specific to a particular card or document, for example an employee number) and invariant data (i.e., data common to a large number of cards, for example the name of an employer).

The security document 10 illustrated in FIG. 5 comprises a multilayer laminate with several laser-sensitive layers. By means of laser treatment of that multilayer laminate, it is possible for different laser-induced markings to be introduced in the laser-sensitive layers, thereby producing a composite laser-induced multilayer image of the personalized information.

The structure of the security document 10 is described in detail hereinafter with reference to the Figures, and also the laser treatment with which it is possible to produce a laser-induced image component in the form of a full-color image.

The security document 10 comprises a laminated structure comprising various papers or plastic laminates and layers in which a plurality of different color markings can be specifically produced by way of laser treatment, and preferably markings of all desired colors can be produced in the manner of a full-color image.

In an embodiment, the security document comprises a body 21. The body 21 can comprise an opaque white core support. The advantage of an opaque white core support is that any personalized information present on the security document 10 is more easily readable and that a color image is more appealing by having a white background.

In an embodiment, the opaque white core support can comprise coated paper supports, such as polyethylene coated paper, polypropylene coated paper; synthetic paper supports, polymeric supports such as opaque white polyesters, . . . .

In another embodiment, instead of an opaque white core support, a white opacifying layer can be coated onto a transparent polymeric support to form the body 21 of the security document. The opacifying layer may comprise a white pigment. The white pigments may be employed singly or in combination.

In an embodiment, the body 21 can comprise a colored core support. In an embodiment, the body 21 can comprise a transparent core support.

In an embodiment, the security document 10 comprises a multilayer assembly 20 arranged on the body 21 of the security document 10. The multilayer assembly 20 comprises at least two layers 20*a*, 20*b*, 20*c*.

As non-limiting examples, the layers 20*a*, 20*b*, 20*c* of the multilayer assembly 20 may be based on such materials as polycarbonates, polyacrylates, certain treated polyvinyl chlorides (PVCs), treated acrylonitrile-butadiene-styrenes (ABSs), or polyethylene terephthalates (PETs), polysiloxanes, epoxy resins, as well as or copolymers or blends thereof. The layers 20*a*, 20*b*, 20*c* may comprise any other suitable plastic material with an incorporated color component compound which can react with laser light to produce desirable markings.

In an embodiment as illustrated in FIG. 5, each layer of the multilayer assembly 20 comprises at least one bleachable color-forming component 31, 33, 35. Each color-forming component 31, 33, 35 comprises two parameters:

one related to an absorption coefficient. The absorption coefficient characterizes which part of the incident light has been absorbed and not reflected/refracted/transmitted by a unit thickness of the target medium. It can be considered as constant at a given wavelength the second related to an effective laser reactivity corresponding to the lowest energy level of the defined laser at the specified wavelength needed by the color-forming component to detect said wavelength. The second one is more system-dependent The color-forming component can be a chromatic color which can be responsive to a particular wavelength by for example changing its color from one chromatic color to a different chromatic color.

The color-forming components in the illustrated implementation are a 'bleachable color-forming components'. The bleachable color component is one colorant from, for example, pigments or eventually dyes or "latent pigments". In an embodiment, the bleachable color component is one color component from, for example, the three primary colors of the subtractive color mixture consisting of yellow, magenta and cyan, or any other chromatic color such as red, green, blue, orange, purple, etc.

In an embodiment illustrated in FIG. 5, the multilayer assembly 20 comprises three layers 20*a*, 20*b* and 20*c* wherein each layer comprises at least one color-forming component 31, 33, 35. The layers 20*a*, 20*b* and 20*c* of the multilayer assembly 20 are arranged over the body 21 of the security document 10.

It should be noted that there may be at least one layer transparent to the laser beam arranged between the layers. The transparent layer can comprise fillers. The fillers can be unrelated to colorants, bleachable colorants or chromatic colors. The transparent layer can be arranged on either side of the multilayer assembly 20. The material of such layer, their number and their order depend on the implementation.

In an embodiment as illustrated in FIG. 5, the multilayer assembly 20 is covered at least with a lamination layer 22. The lamination layer 22 provides security in that it protects the personalized information produced by the laser marking from physical manipulation. The lamination layer 22 is transparent to the laser beam used to produce the final personalized image in the multilayer assembly 20.

According to an implementation of the present invention, the security document 10 can comprise a multilayer assembly 20 without a lamination layer 22 covering the layers 20*a*, 20*b* and 20*c*.

It should be noted that there may be multiple layers between the body 21 of the security document 10 and the multilayer assembly 20. There should be noted that there may be multiple layers over the multilayer assembly 20 The material of such layers and their order depend on the implementation.

In the embodiment illustrated at FIG. 5, the multilayer assembly 20 is located between the opaque white core support of the body 21 and the transparent lamination layer 22.

In an embodiment illustrated in FIG. 5, the multilayer of the security document 10 comprises an infrared laser-markable layer 23 for generating different optical densities of grey to black. The infrared laser markable layer 23 is situated between the multilayer assembly 20 and the body 21. The infrared laser markable layer 23 comprises an infrared absorber which is capable of converting the infrared light of an infrared laser into heat which triggers the reaction of generation of the grey/black color.

During personalization, the laser beam carbonizes the infrared laser markable layer 23 in its bulk volume, thereby forming non-reflective black volumes so as to form the gray levels of the personalized image. The energy delivered by the laser is adjusted so as to produce all of the shades of gray required to enhance the formation of an attractive and contrasted color laser image.

In an embodiment, the infrared laser markable layer 23 could be from the multilayer assembly 20 by another layer 24. The layer 24 is transparent to the infrared laser beam used to produce the final personalized image in the infrared laser markable layer 23.

The assembly of the multilayers of the security document 10 is bonded under pressure on the core assembly of the security document 10. This bonding operation is known as "lamination" by the person skilled in the art. In other words, the multilayer are laminated on the body 21 of the security document 10.

In an embodiment, the multilayer of the security document 10 is preferably combined with one or more other security features to increase the difficulty for falsifying the document.

To prevent forgeries, different means of securing can be used. One solution can consist in superimposing lines or guilloches on an identification picture such as a photograph. In that way, if any material is printed subsequently, the guilloches appear in white on added black background. Other solutions can consist in adding security elements such as information printed with ink that reacts to ultraviolet radiation, micro-letters concealed in an image or text etc.

Suitable other known security features, such as anti-copy patterns, guilloches, endless text, miniprint, microprint, nanoprint, rainbow coloring, 1D-barcode, 2D-barcode, colored fibres, fluorescent fibres, fluorescent pigments, OVD and DOVID such as holograms, 2D and 3D holograms, relief embossing, perforations, metallic pigments, magnetic material, images made with OVI (Optically Variable Ink) such as iridescent and photochromic ink, images made with thermochromics ink, phosphorescent pigments and dyes, watermarks including duotone and multitone watermarks, ghost images and security threads, can be added to the multilayer of the security document 10.

Figure 6:
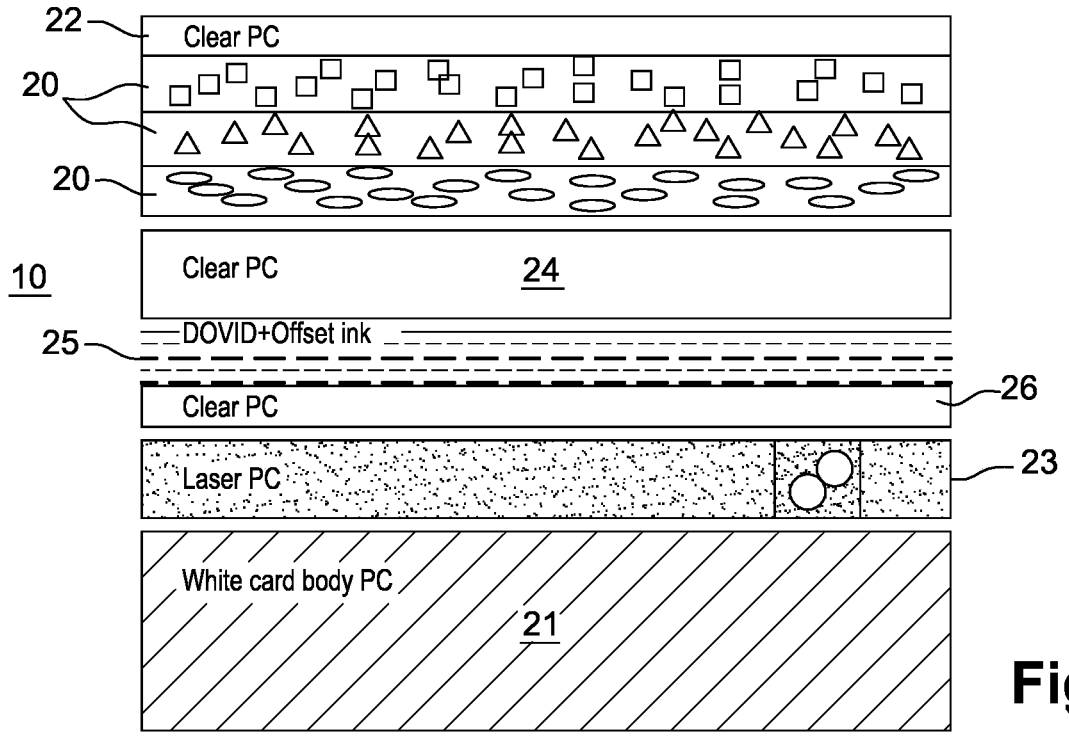
FIG. 6 schematically illustrates a sectional view of a multilayered security document, according to another implementation of the present invention, comprising a multilayer assembly.

In the example illustrated in FIG. 6, a security feature 25 is arranged between the infrared laser markable layer 23 and the layer 24. In this implementation illustrated, the security feature is a DOVID and an offset-printed element. In an embodiment, the infrared laser markable layer 23 could be from the security feature 25 by another layer 26. The layer 26 like the layer 24 is transparent to the infrared laser beam used to produce the final personalized image in the infrared laser markable layer 23.

In another implementation, the security feature can be arranged over the multilayer assembly 20.

Figure 8:
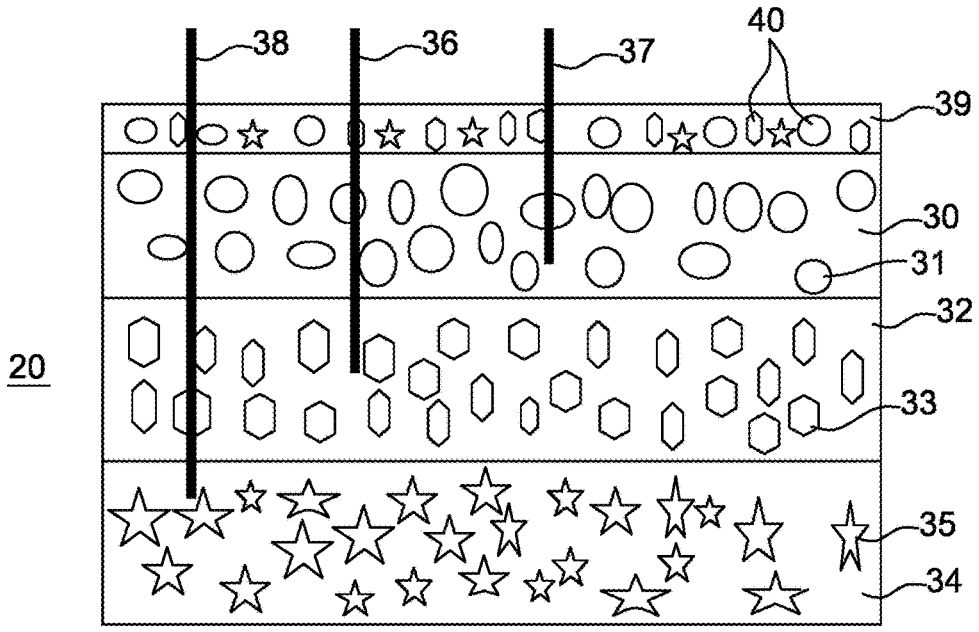
FIG. 8 schematically illustrates a sectional view of the multilayer assembly according to an implementation of the present invention.

FIG. 8 illustrates an embodiment of a configuration order of the layers 20*a*, 20*b*, 20*c* of the multilayer assembly 20.

The multilayer assembly 20, according to the present invention, comprises at least two separate layers 20*a*, 20*b*, 20*c*, but preferably can comprise three or more separate layers. The separate layers of the multilayer assembly 20 are positioned over the opaque white core support of the body 21 for producing a multicolored security document 10.

In an embodiment as illustrated in FIG. 8, the multilayer assembly 20 is formed by three layers 20*a*, 20*b* and 20*c* wherein each of them comprises a single bleachable color-forming component.

At least one color-forming component is transferred into each of the layer 20*a*, 20*b*, 20*c* of the multilayer assembly 20 according to any known color transfer technique.

The order layout of the layers of the multilayer assembly 20 is determined according to the recorded absorption spectra/absorption coefficients and the effective laser reactivity of each of the color-forming components of each layer. The order layout is determined so that an undesirable bleaching of a given color-forming component is prevented.

Figure 7:
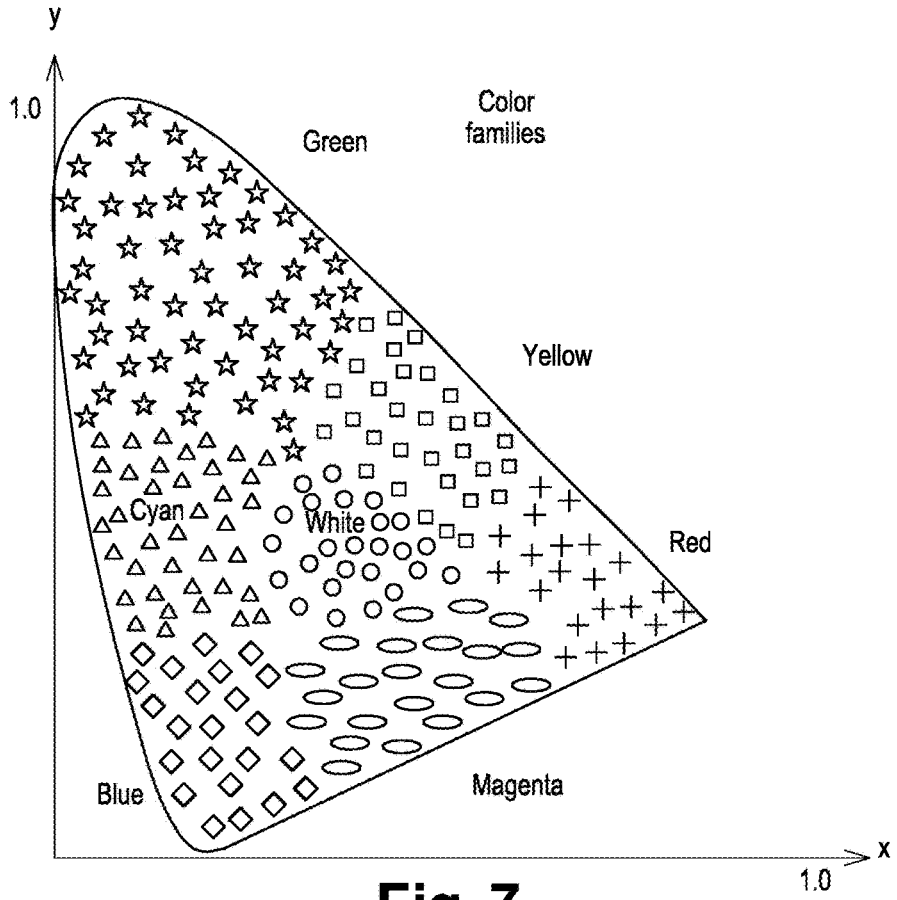
FIG. 7 schematically illustrates a diagram of the color gamut available after the bleaching laser treatment of the multilayer of the pigments according to the present invention.

With the order layout as proposed by the present invention, a chosen color is easily obtained because during bleaching of a selected color-forming component, a bleaching interference of the others color-forming components is minimized. Indeed, with the present invention, one wavelength can bleach one color-forming component extending by this way the attainable color space. With the order layouts as proposed by the present invention, the color gamut is improved. FIG. 7 illustrates a resulting representation of the color gamut, according to an embodiment of the present invention, where each color-forming component corresponds to one of the three primary colors: yellow, magenta, cyan.

A first order layout is determined according to the absorption coefficients of the bleachable color-forming components of each layer at the defined laser wavelengths. Each layer of the multilayer assembly 20 acts as a filter for a specific wavelength. Said filter is configured to selectively transmit predefined wavelengths and block or attenuate other wavelengths. The final optimized order layout is determined according to the relative effective laser reactivity of the bleachable color-forming component of each layer. Determination of the effective laser reactivity of the bleachable color-forming components leads to changing the first order layout in the aim to protect bleachable color-forming components with the highest effective laser reactivity.

In the final order layout, the color-forming component of each color-forming layer is selected to block or attenuate the laser light at the wavelengths according to their absorption coefficients while protecting color-forming components with the highest effective laser reactivity from "untargeted" bleaching. The effective laser reactivity of a color-forming component is an empirical characteristic of the pigment-laser pair within the system in question, accounting of the entire range of the laser-induced physico-chemical processes resulting in color component discoloration.

The final layout is determined so that, the first wavelength blocked is the one able to bleach at least substantially a majority of the color-forming components of the layers of the multilayer assembly 20. The color-forming component of the upper layer of the multilayer assembly 20 is selected with the purpose of screening off or reducing the light intensity of the first wavelength in the aim to prevent from bleaching the color-forming components of the underneath layers. The selection of the color-forming component is therefore determined layer by layer successively in the aim to block or attenuate laser light at applied wavelengths thus preventing them from bleaching the color components with the highest effective laser reactivity. The color component with the highest effective laser reactivity is the color component having the lower energy threshold to be bleached.

The present invention with the multilayer assembly allows to expand the achievable color gamut, in which color images are generated, as shown in FIG. 7, and to improve the perceived quality of the generated images.

As illustrated in FIG. 8, a first layer 30 is arranged on the upper surface of the multilayer assembly 20. This first layer 30 can be covered by the laminated layer 22, according to the implementation. The first layer 30 comprises a first color-forming component 31. A second layer 32 arranged between the first layer 30 and a third layer 34 comprises a second color-forming component 33. The third layer 34 arranged over the body 21 of the security document 10 comprises a third color-forming component 35.

For bleaching the first color-forming component 31, there is a first laser condition, for example a first specific laser wavelength 37; for bleaching the second color-forming component there is a second laser condition, for example a second specific laser wavelength 36, and for bleaching the third color-forming component there is a third laser condition, for example a third specific laser wavelength 38. Those specific laser conditions or laser wavelengths used for bleaching the various components are respectively different from each other.

The color-forming components (one or more) are selected for each layer according to their absorption properties and their effective laser reactivity.

The color-forming components of the layers underneath the first layer can absorb in the range where the first color-forming component 31 absorbs,—even if it could be considerably less. To avoid this unwanted exposure the color component of the first color-forming component 31 is selected to act as a filter of the first wavelength 37 in the aim to block it or attenuate it into bleaching the color-forming components located underneath. The first color-forming component 31 acting as a filter for the first wavelength 37 allows to minimize the "side-effect" bleaching of the underneath color-forming components while keeping the "targeted" bleaching as complete as possible.

The color-forming components of the layers underneath the second layer can absorb in the range where the second color-forming component 33 absorbs,—even if it could be considerably less. To avoid this unwanted exposure the color component of the second color-forming component 33 is selected to act as a filter of the second wavelength 36 in the aim to block it or attenuate it into bleaching the underneath color-forming components.

The third color-forming component 35 is selected as the one with the highest effective laser reactivity towards the "improper" lasers. The present invention allows to determine the best compromise between «bleaching» and «protecting», so that the bleaching is most complete and at the same time most selective—in order to expand the attainable color gamut/the range of attainable colors.

The predefined order of arranging each color-forming component into the multilayer assembly 20 located over the body 21 allows that under the respective specific laser conditions for a color component, for example the specific laser wavelength, only that one color component can be bleached and in that procedure the other color components cannot be bleached or their bleaching is significantly minimized. In that way it is possible for only one respective color component to be specifically bleached in the laser treatment, while the others are left unaltered.

In an embodiment of the present invention, the first color-forming component 31 of the first color-forming layer 30 is selected so that wavelength in the blue range for example under 470 nm is effectively blocked or attenuated by the pigments, operating by this way as optical low-pass filter, and consequently widen the color gamut, improving then the range of possible output colors.

Herein after is described an example of implementation of the present invention during a process production of a full-color image of personalized information in a laser-induced process. In order to be able to operate with few color component components but to be able to produce as many colors as possible and preferably all colors, the preferred color-forming components correspond to the three primary colors, such as a cyan pigment, a magenta color component and a yellow pigment. All colors can be produced with these three primary colors using the subtractive color scheme by targeted bleaching of the selective color-forming component.

In order to bleach the yellow pigment, blue laser light is used for that purpose. In order to bleach the magenta pigment, green laser light is used for that purpose. In order to bleach the cyan pigment, red laser light is used for that purpose. A given minimum intensity is required for the bleaching operation.

According to the absorption coefficient of each color-forming component of each layer and also their effective laser reactivity, the first color-forming component 31 comprises yellow color component acting like a filter of the blue laser light. The yellow color component of the first layer 30 of the multilayer assembly 20 blocks or attenuates the blue light reducing considerably its bleaching impact on the other color-forming components of the second and the third layers. The green laser light and the red laser light are transmitted without attenuation through the first layer 30 containing the yellow pigment.

The second color-forming component 33 comprises the cyan color component acting like a filter of the said red laser. The second layer comprises the cyan pigment. The cyan color component of the second layer 32 blocks or attenuates the red laser and the transmitted portion of the blue laser light reducing considerably their bleaching impact on the magenta color component of the third layer 34. The green laser light is transmitted without attenuation through the second layer 20 comprising the cyan pigment.

During the process for the production of a multicolor image, only the yellow color component is bleached by the blue laser irradiation. The red laser light, irradiating the body 21 of the security document, is transmitted without attenuation through the yellow-first layer 30 and bleaches only the cyan color component of the second layer 32. The green laser, irradiating the body 21 of the security document 10, is practically transmitted without attenuation through the yellow- and the cyan-first and second layers to bleach the magenta color component inside the third layer 34.

The multicolor image is accordingly formed by the combination of the residual (unbleached) color components of the first, second and third layers after the laser treatment.

In an embodiment, the laser treatment can be carried out with the aid of one or more laser apparatuses, which irradiate laser light of a single wavelength that corresponds to the wavelength value chosen on the basis of the desired color of the mark.

In another embodiment, the laser treatment is carried out with the aid of a laser apparatus with an adjustable wavelength. With such an apparatus the wavelength required for the color chosen for the mark can easily be set. It is then also possible to obtain a mark containing more than one color with the aid of one apparatus.

In an embodiment, the bleaching operation of each specific wavelength can be done simultaneously or sequentially.

Even though a wider color gamut has been reached, it has been observed that the quality perception of the resulting multicolor image resulting from the laser treatment is not as good as expected. It appears that defining a specific order based on optimized laser selectivity for each color-forming component of each layer of the multilayer assembly 20, isn't sufficient for a good visual quality perception. The color perception is indeed affected by the reflection or interference from the color of the first layer 30 after the laser treatment.

As the top most layer bears a chromatic color (that is it does not uniformly absorb across the visible region)—which is the case for the embodiment with the upper yellow layer, then the visual perception is impacted by the selective reflection of the daylight from the bulk of the said layer. Thus, the image is perceived as tinted into the color of the upper layer.

When the color-forming component 31 of the upper layer 30 is yellow, a yellowish aspect in the final multicolor image is observed.

To overcome this drawback, in an embodiment, the multilayer assembly 20 comprises a fourth layer 39. The fourth layer 39 is arranged over the first upper layer 30. In an embodiment, the forth layer 39 comprises a color component mixture 40 of at least two color-forming components. The overall observed color of the color component mixture 40 can be a neutral grey. The color component mixture 40 can comprise a mixture of the underneath three color-forming components. The color component mixture 40 can comprise a mixture of at least two different color-forming components.

In an embodiment, the concentration of the color component mixture 40 can be lower compared to the concentration of the color-forming components in the other layers of the multilayer assembly 20.

In an embodiment, the color component concentration of the color component mixture 40 can be selected so that the visual colored tint caused by the chromatic color underneath is minimized. In another embodiment, the color component concentration of the color component mixture 40 can be selected so that its pigments could be (preferably completely) bleached without significantly affecting the bleaching process in the layers underneath.

The coloring effect of this fourth layer is produced as a subtractive color scheme with those three primary colors by specific bleaching of the individual color component of each color-forming component.

After the laser treatment, all three components of the fourth layer 39 have been bleached or have been bleached more or less, according to the respective degree of bleaching. Therefore, depending on a possible colored background layer or also possible further components in the body or in the same layer of the body, the above-mentioned location of the body appears colorless or tinted, and in the limit case it can appear white when the background is white. In an embodiment, this fourth mixed layer 39 allows to reduce considerably the visual yellowish appearance without destroying the benefits of the multilayer assembly 20.

It will be appreciated by those skilled persons that changes could be made to the embodiments described above without departing from the broad inventive concept thereof. It is understood, therefore, that this invention is not limited to the particular embodiments disclosed, but it is intended to cover modifications, variations, combinations and equivalents within the scope of the present invention.

The invention claimed is:

1. A multilayer assembly, said multilayer assembly comprising:

at least a first layer and a second layer, wherein one of said first and second layer is arranged to be located above the other of said first and second layers, wherein the layers are arranged so that:

the first layer has a first color-forming component of a first concentration and acts as an absorptive optical filter configured to selectively transmit the light of a first range of wavelengths and block or attenuate the light outside the first range of wavelengths, the second layer has a second color-forming component of a second concentration and acts as an absorptive optical filter configured to selectively transmit the light of a second range of wavelengths and block or attenuate the light outside the second range of wavelengths, a sensitive layer above the upper layer of the first layer and the second layer, said sensitive layer comprising a color component mixture of at least the first and second color-forming components in a concentration lower than the first and second concentration of the color-forming components in the first and second layers of the multilayer assembly, respectively, and that during the irradiation of a selected color-forming component by a selected laser wavelength, an untargeted radiation exposure of the color forming component underneath the selected color-forming component is avoided or at least minimized.

2. The multilayer assembly according to claim 1 wherein, arrangement of the layers is determined according to two parameters:

an absorption coefficient of each color-forming component of the layers at a given wavelength, an effective laser reactivity of each color-forming component of the layers, said effective laser reactivity corresponding to the minimum energy input of the given wavelength required to achieve a targeted color change of the color-forming component.

3. The multilayer assembly according to claim 2 wherein, the layers are arranged so that:

according to the coefficient of absorption of each color-forming component, each layer acts as a longpass filter wherein laser irradiation of longer wavelength is transmitted whereas laser irradiation of shorter wavelength is blocked or attenuated, and according to the effective laser reactivity of each color-forming component, each layer allows to minimize the untargeted radiation exposure of the underneath color-forming components.

4. The multilayer assembly according to claim 3 wherein, the color component is a chromatic color which pass from one chromatic color to a different chromatic color when exposed to a given wavelength, or a bleachable color component which is bleached under given wavelength.

5. The multilayer assembly according to claim 1, wherein the layers are separated by a layer transparent to laser irradiation.

6. The multilayer assembly according to claim 1, wherein the color-forming component is color component or dye or "latent pigment".

7. The multilayer assembly according to claim 6, wherein:

the first layer is arranged above the second layer and wherein the first color-forming component is a bleachable color-forming component yellow which is able to block or attenuate blue-light wavelength band, while other color wavelengths pass through, a second layer arranged below the first layer and wherein the second color-forming component is a bleachable color-forming component cyan, said second layer being able to block or attenuate red-light wavelength band while other wavelengths pass through, a third layer arranged below the second layer with a third color-forming component being a bleachable color-forming component magenta, said third layer being able to block or attenuate green-light wavelength band while other color wavelengths pass through.

8. The multilayer assembly according to claim 1, wherein the multilayer assembly is covered by a lamination layer transparent to the laser wavelengths.

9. A multilayered security document comprising:

a body support over which is arranged a multilayer assembly, said multilayer assembly having at least a first layer and a second layer, wherein one of said first and second layer is arranged to be located above the other of said first and second layers, wherein the layers are arranged so that:

the first layer has a first color-forming component of a first concentration and acts as an absorptive optical filter configured to selectively transmit the light of a first range of wavelengths and block or attenuate the light outside the first range of wavelengths, the second layer has a second color-forming component of a second concentration and acts as an absorptive optical filter configured to selectively transmit the light of a second range of wavelengths and block or attenuate the light outside the second range of wavelengths, a sensitive layer is above the upper layer of the first layer and the second layer, said sensitive layer comprising a color component mixture of at least the first and second color-forming components in a concentration lower than the first and second concentration of the color-forming components in the first and second layers of the multilayer assembly, respectively, and that during the irradiation of a selected color-forming component by a selected laser wavelength, an untargeted radiation exposure of the color forming component underneath the selected color-forming component is avoided or at least minimized.

10. A multilayered security document according to claim 9, wherein the body support comprises an opaque white core support, a white opacifying layer coated onto a transparent polymeric support, a colored core support or a transparent core support.

11. The multilayered security document according to claim 9, wherein the security document comprises an infrared laser markable layer for generating different optical densities of grey to black, said infrared laser markable layer being arranged between the multilayer assembly and the body support.

12. The multilayered security document according to claim 9, wherein the security document comprises one or more other security features arranged on a layer between the body support and the multilayer assembly or over the multilayer assembly.

13. The multilayered security document according to claim 9, wherein the multilayers of the security document are laminated on the body support of the security document.

14. The multilayered security document according to claim 9, wherein the security document is a physical media selected from the group contacted smart cards, contactless smart cards, driver's licenses, passports, government-issued identity cards, bankcards, employee identification cards, security documents, personal value papers such as registrations, proofs of ownership, visas, immigration documentation, security badges, certificates, voter registration cards, police ID cards or border crossing cards.

15. A method of color laser marking of a multilayered security document having a multilayer assembly, said multilayer assembly comprising at least two layers, each layer comprises at least one color-forming component, a color marking is produced on the multilayer assembly of the security document, the method comprising:

arranging at least a first layer and a second layer, wherein one of said first and second layer is arranged to be located above the other of said first and second layers, wherein the layers are arranged so that:

the first layer has a first color-forming component of a first concentration and acts as an absorptive optical filter configured to selectively transmit the light of a first range of wavelengths and block or attenuate the light outside the first range of wavelengths, the second layer has a second color-forming component of a second concentration and acts as an absorptive optical filter configured to selectively transmit the light of a second range of wavelengths and block or attenuate the light outside the second range of wavelengths, wherein a sensitive layer is added over the upper layer of the first layer and the second layer, said sensitive layer comprising a color component mixture of at least the first and second color-forming components in the first and second layers of the multilayer assembly in a concentration lower than the first and second concentration of the color-forming components in the first and second layers of the multilayer assembly, respectively, and that during the irradiation of a selected color-forming component by a selected laser wavelength, an untargeted radiation exposure of the color forming component underneath the selected color-forming component is avoided or at least minimized; and selectively transforming the color-forming components of the layers by irradiation at selected laser wavelengths.

16. The method of color laser marking of a multilayered security document of claim 15, further comprising:

determining arrangement of the layers according to two parameters:

an absorption coefficient of each color-forming component of the layers at a given wavelength, an effective laser reactivity of each color-forming component of the layers, said effective laser reactivity corresponding to the minimum energy input of the given wavelength required to achieve a targeted color change of the color-forming component.

17. The method of color laser marking of a multilayered security document of claim 16, comprising:

arranging the layers so that:

according to the coefficient of absorption of each color-forming component, each layer acts as a long-pass filter wherein laser irradiation of longer wavelength is transmitted whereas laser irradiation of shorter wavelength is blocked or attenuated, and according to the effective laser reactivity of each color-forming component, each layer allows to minimize the untargeted radiation exposure of the underneath color-forming components.

18. The method of color laser marking of a multilayered security document of claim 17 wherein, the color component is a chromatic color which pass from one chromatic color to a different chromatic color when exposed to a given wavelength, or a bleachable color component which is bleached under given wavelength.

19. The method of color laser marking of a multilayered security document of claim 15, comprising separating the layers by a layer transparent to laser irradiation.

20. The method of color laser marking of a multilayered security document of claim 15, wherein the color-forming component is color component or dye or "latent pigment".

21. The method of color laser marking of a multilayered security document of claim 20, wherein:

the first layer is arranged above the second layer and wherein the first color-forming component is a bleachable color-forming component yellow which is able to block or attenuate blue-light wavelength band, while other color wavelengths pass through, the second layer arranged below the first layer and wherein the second color-forming component is a bleachable color-forming component cyan, said second layer being able to block or attenuate red-light wavelength band while other wavelengths pass through, a third layer arranged below the second layer with a third color-forming component being a bleachable color-forming component magenta, said third layer being able to block or attenuate green-light wavelength band while other color wavelengths pass through.

22. The method of color laser marking of a multilayered security document of claim 15, further comprising:

covering the multilayer assembly with a lamination layer transparent to the laser wavelengths.

* * * * *